US006089789A

United States Patent [19]

Santamaria

[11] Patent Number: 6,089,789

[45] Date of Patent: Jul. 18, 2000

[54] BARRIER FOR WATER TREATMENT

[75] Inventor: Joseph P. Santamaria, Bristol, N.H.

[73] Assignee: JPS Industries, Inc., Bristol, N.H.

[21] Appl. No.: 09/229,539

[22] Filed: Jan. 13, 1999

Related U.S. Application Data

[60] Provisional application No. 60/081,391, Apr. 10, 1998.

[51] Int. Cl.[7] ..... F02B 15/04

[52] U.S. Cl. ..... 405/63

[58] Field of Search ..... 405/60, 63, 64, 405/65, 66, 67, 68, 69, 70, 71, 72

[56] References Cited

U.S. PATENT DOCUMENTS

| | | | |
|---|---|---|---|
| 3,549,599 | 12/1970 | Reilly | 405/70 |
| 3,592,008 | 7/1971 | Trindle | 405/70 |
| 3,708,983 | 1/1973 | Brown et al. | 405/70 |
| 4,188,155 | 2/1980 | Langermann | 405/63 |
| 4,300,857 | 11/1981 | Santamaria | 405/70 |
| 4,425,053 | 1/1984 | Muro et al. | 405/63 |
| 4,534,675 | 8/1985 | Morrisroe | 405/63 |
| 4,688,024 | 8/1987 | Gadde | 405/63 |
| 5,064,309 | 11/1991 | Dickie et al. | 405/64 |

*Primary Examiner*—Eileen Dunn Lillis
*Assistant Examiner*—Frederick L Lagman
*Attorney, Agent, or Firm*—Weingarten, Schurgin, Gagnebin & Hayes LLP

[57] ABSTRACT

A barrier which can be easily deployed in a lagoon, pool or other containment structure to partition and provide isolation between adjacent bodies of water or other liquid. As a result, different treatment operations can occur in the adjacent bodies of water which are separated by the novel curtain barrier. The bodies of water can also be easily rearranged by use of the invention. The barrier includes first and second curtains of flexible water impermeable material which are disposed in a generally vertical disposition and the bottoms of which are joined to a bottom web which preferably is integrally formed with the first and second curtains. The bottom web is adapted to be disposed on the lagoon bottom and ballast material is contained between the first and second curtains on the bottom web to seal the barrier to the lagoon bottom and to prevent movement of the barrier in response to wind, tide, current or other forces. The curtains extend upwardly above the surface of the water and are maintained in a generally vertical or upright orientation by floatation devices disposed along the length of the curtains.

13 Claims, 3 Drawing Sheets

BARRIER FOR WATER TREATMENT

CROSS REFERENCE TO RELATED APPLICATIONS

This application claims priority to U.S. provisional patent application No. 60/081,391, entitled Barrier Curtain for Water Treatment, filed Apr. 10, 1998 and incorporated herein by reference.

STATEMENT REGARDING FEDERALLY SPONSORED RESEARCH OR DEVELOPMENT

Not Applicable

BACKGROUND OF THE INVENTION

For purposes of water treatment, water from a processing or treatment facility is often contained in a lagoon, pool or other containment structure in which a particular treatment takes place. The treatment may be for example the addition of particular chemicals for water purification, the settling of sediment and other particulates from the body of water, or the cooling of water. The cost of constructing and maintaining permanent containment lagoons is relatively high and does not allow for rearrangement of such lagoons for different processes in a simple and cost effective manner. A known water barrier curtain which is in present use is the water flow diversion curtain which may be contoured along its bottom edge to conform to the shape of the bottom of the basin containing the water as disclosed in U.S. Pat. No. 4,300,857. However, such marine barrier is designed for diversion of flows of water passing through a basin and is not particularly effective for isolation of adjacent bodies of water or other liquid. For the foregoing reasons, there is a need for a cost effective and easy to install barrier curtain for water treatment.

BRIEF SUMMARY OF THE INVENTION

The present invention is directed to a barrier which can be easily deployed in a lagoon, pool or other containment structure to partition and provide isolation between adjacent bodies of water or other liquid. As a result, different treatment operations can occur in the adjacent bodies of water which are separated by the novel barrier. The bodies of water can also be easily rearranged by use of the invention.

The barrier in accordance with the invention includes first and second curtains of flexible water impermeable material which are disposed in a generally vertical disposition and the bottom of which are joined to a bottom web which preferably is integrally formed with the first and second curtains. The bottom web is adapted to be disposed on the lagoon bottom and ballast material is contained between the first and second curtains on the bottom web to seal the barrier to the lagoon bottom and to prevent movement of the barrier in response to wind, tide, current or other forces. The first and second curtains extend upwardly above the surface of the water and are maintained in a generally vertical or upright orientation by floatation devices disposed along the length of the curtains. The curtains can be reinforced with a plurality of parallel spaced ribs extending from the top toward the bottom of the curtains. End anchors support the curtain ends.

BRIEF DESCRIPTION OF THE SEVERAL VIEWS OF THE DRAWING

These and other features, aspects, and advantages of the present invention will become better understood with regard to the following description, appended claims, and accompanying drawings where:

DETAILED DESCRIPTION OF THE INVENTION

Figure 1:
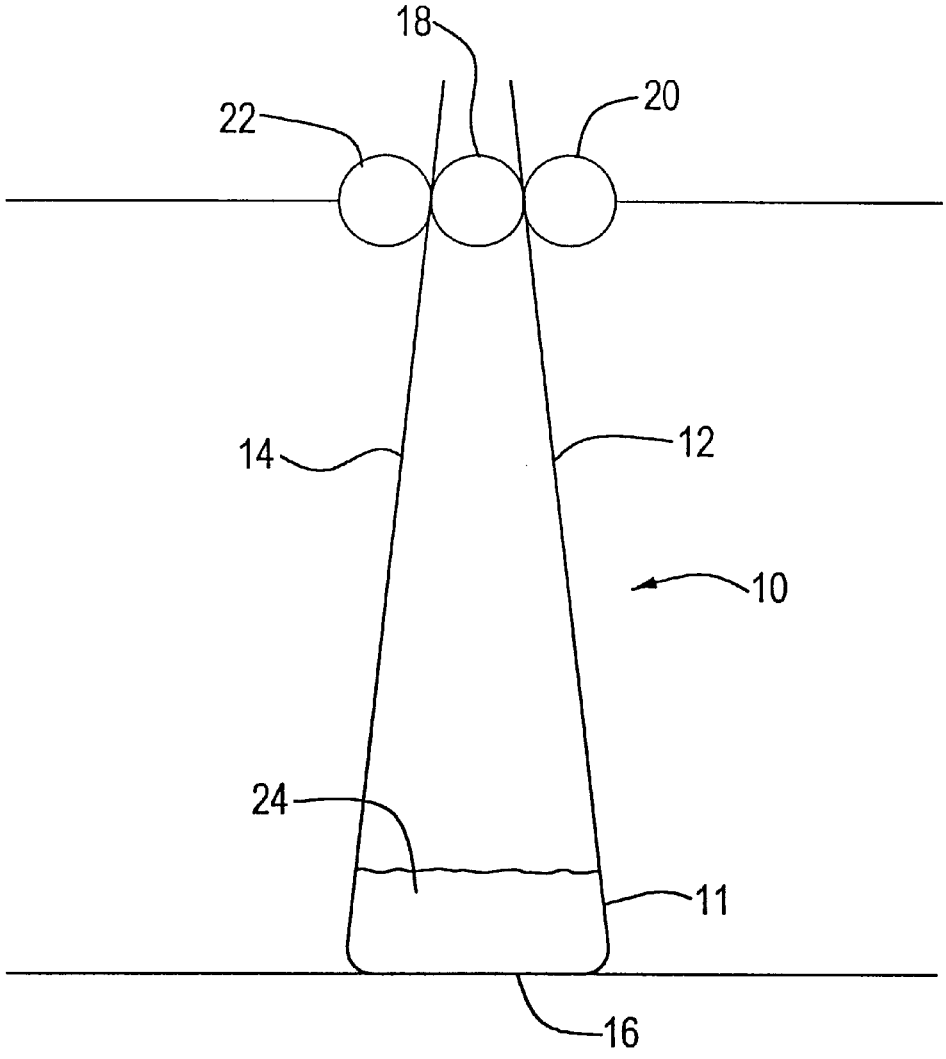
FIG. 1 is a cross-sectional end view of a portion of the barrier of this invention.
Figure 2:
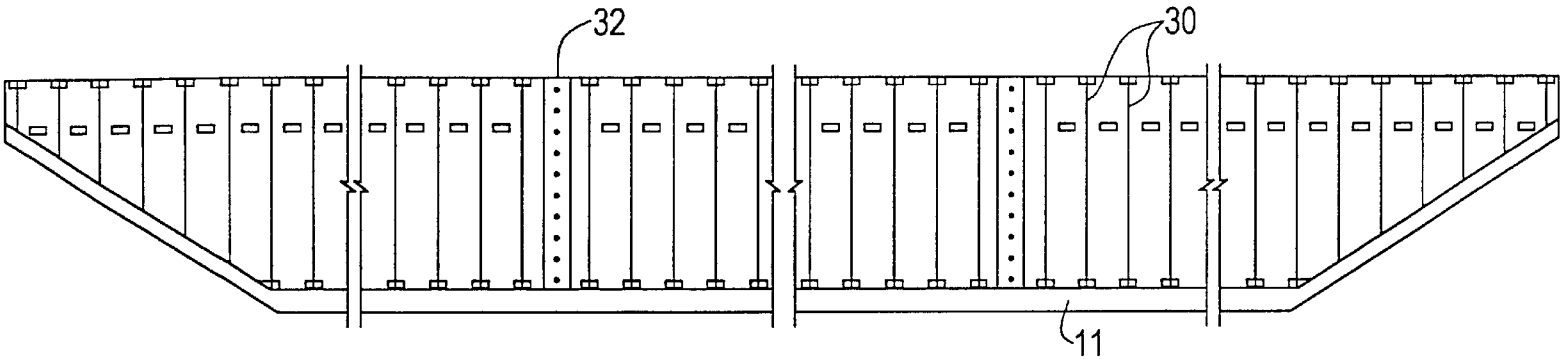
FIG. 2 is a side elevation view of FIG. 1.

A preferred embodiment of the invention is shown in FIGS. 1 and 2 which depicts the barrier installed on a lagoon bottom to separate bodies of water located on opposite sides of the barrier. The barrier 10 is composed of a first curtain 12 and a second curtain 14 each formed of flexible water impermeable material such as Nylon. The curtains 12 and 14 are joined to and preferably are integral with a bottom web 16 which can be of the same flexible water impermeable material. The bottom web 16 is disposed on the lagoon bottom which typically is a sand or dirt bottom, and the curtains 12 and 14 are disposed in a generally vertical disposition extending above the water surface, and are retained in their upright orientation by floats 18, 20 and 22 attached near the upper end of the curtains. A portion of the bottom web 11 extends upwardly from the lagoon bottom as shown in FIG. 1. In the illustrated embodiment, a float 18 is disposed between the curtains and floats 20 and 22 are disposed on respective outer sides of the curtains. The floats are disposed along the length of the curtain at a spacing appropriate to maintenance of the overall barrier in an upright position.

A ballast material 24 is provided on the inner surface of the bottom web between the curtains 12 and 14 to provide sufficient weight to maintain the barrier on the lagoon floor and to prevent movement of the barrier due to wind, tide or other forces. The ballast material is typically an aggregate of stones or sand in an amount to provide the weight sufficient to withstand the expected forces on the barrier. The bottom web is of sufficient width to accommodate an extended amount of ballast to resist the expected forces caused by water flow or current. Typically, widths in the range of 24 to 36 inches are suitable.

Figure 5:
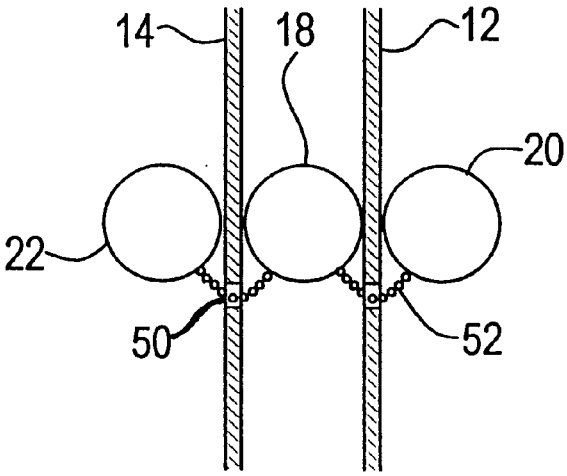
FIG. 5 is a cutaway end view of the float attachment.

The floats are attached to the curtains 12 and 14 near the upper ends of the curtains as shown in FIG. 5. Grommeted openings 50 are provided along the curtains near the top edges, and a chain 52 or other tether is threaded through each grommeted opening, the ends of the chain being connected to respective floats as illustrated. The floats are thereby attached to the curtains, and upon installation of the barrier in the lagoon the floats are buoyantly supported on the water surface and maintain the upward disposition of the barrier curtains.

Figure 4:
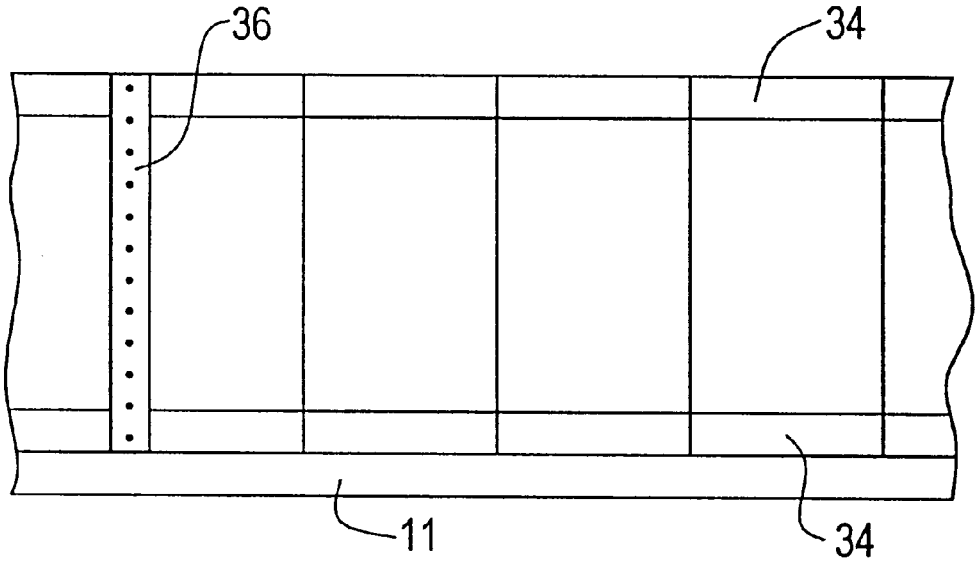
FIG. 4 is a cutaway elevation view of the curtain showing the panel consideration.

In a typical embodiment, the curtain material is 28 ounce per square yard two way Nylon scrim with rip stops every fourth filament, and impregnated with PVC. The curtains can be reinforced with a plurality of parallel spaced stiffening rods or ribs 30 extending from the top toward the bottom of the curtains. Typically, the stiffening rods are positioned approximately 24 inches apart along the length of the respective curtains 12 and 14. The rods are preferably 5/16 inch diameter pre-stressed molded fiberglass rods which are stitched into pockets in the curtains. The barrier curtains are fabricated in panels of predetermined length, typically 50 feet. The curtain panels are joined together to form an overall barrier of intended length by stitching or otherwise fastening the panels together as shown at reference 32 of FIG. 2. The panels can be constructed as shown in FIG. 4. A Nylon web 34, preferably 2 inch 4-ply silicone treated, can be used along the tops and bottoms of the curtain panels, and a Nylon web 36, preferably 3 inch 4-ply silicone treated, can be used at the start and joint ends of the panels. The curtains 12 and 14 and the bottom web 16 are preferably lockstitched with a triple strand 1802 silicone treated Nylon thread and double stitched in load areas.

Figure 3:
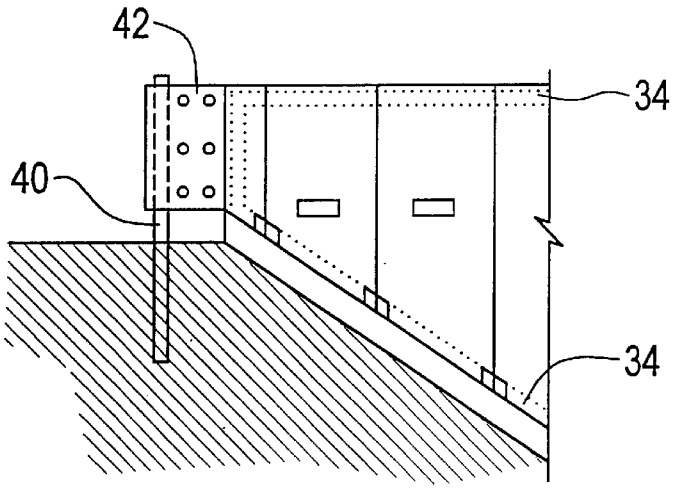
FIG. 3 is a cutaway elevation view of an anchor end of the barrier.

As shown in FIG. 3, each end of the barrier curtain is anchored to a support post 40 which is disposed in the ground or other structure on the side of the lagoon. The post is fastened to the curtain by an end plate 42. The height of the barrier curtains can be tapered as illustrated to follow the contour of the lagoon sides. Other end anchor arrangements can be provided to suit the particular anchoring structure to which the barrier ends are to be affixed.

The bottom web 16 and upwardly extending portions 11 are sufficiently flexible to provide a compliant seal with the lagoon bottom on which the bottom web rests. The seal is maintained by the ballast material 24 introduced between the curtains 12 and 14 on the inner surface of the bottom web.

To install the barrier in a lagoon or other body of liquid, one end of the curtains are anchored to the lagoon side and the barrier extended along an intended path. Ballast material is introduced into the barrier to maintain the position of the barrier along the intended path, and the other end of the barrier is then anchored to the opposite side of the lagoon. Installation techniques can vary to suit particular site requirements.

It will be appreciated that variations and modifications in the construction of particular embodiments of the invention can be made without departing from the spirit and true scope of the invention. The invention is not therefore to be limited by what has been particularly shown and described.

What is claimed is:

1. A barrier for partitioning and providing isolation between adjacent bodies of liquid in a containment structure, comprising:

first and second curtains of flexible liquid impermeable material disposed in a generally vertical disposition;

a bottom web of flexible liquid impermeable material joined to the first and second curtains and adapted to be disposed on the bottom of the containment structure;

ballast material on the bottom web between the first and second curtains and operative to seal the barrier to the bottom of the containment structure and prevent movement of the barrier;

anchoring apparatus for anchoring each end of the first and second curtains; and a plurality of floats disposed along the length of the curtains and at each location a first float disposed between the curtains and second and third floats disposed on respective outer sides of the curtains, the plurality of floats cooperative with the curtains to maintain the curtains in an upright generally vertical position in the bodies of liquid; and an attachment mechanism for attaching the floats to the curtains.

2. The barrier of claim 1 wherein each of the first and second curtains are composed of a plurality of panels of flexible liquid impermeable material joined together to provide curtains of intended length.

3. The barrier of claim 2 including a plurality of stiffening rods spaced along the length of each of the first and second curtains and extending from the top of the curtains toward the bottom of the curtains.

4. The barrier of claim 3 wherein each of the first and second curtains include pockets for retaining respective stiffening rods.

5. The barrier of claim 1 wherein the first and second curtains each include reinforcing webs provided along the top and bottom of the curtains and along the ends of the curtains.

6. The barrier of claim 1 wherein the bottom web is of the same flexible liquid impermeable material as the first and second curtains and wherein the bottom web and first and second curtains are joined together by stitching.

7. A barrier for partitioning and providing isolation between adjacent bodies of liquid in a containment structure, comprising:

first and second curtains of flexible liquid impermeable material disposed in a generally vertical disposition;

a bottom web of flexible liquid impermeable material joined to the first and second curtains and adapted to be disposed on the bottom of the containment structure;

ballast material on the bottom web between the first and second curtains and operative to seal the barrier to the bottom of the containment structure and prevent movement of the barrier;

anchoring apparatus for anchoring each end of the first and second curtains, wherein the anchoring apparatus includes a plurality of anchoring posts which are adapted for attachment to an anchoring structure outside of the body of liquid, and a connection mechanism for connecting each anchor post to a respective end of a curtain; and a plurality of floats disposed along the length of the curtains and cooperative with the curtains to maintain the curtains in an upright generally vertical position in the bodies of liquid.

8. The barrier of claim 7 wherein each of the first and second curtains are composed of a plurality of panels of flexible liquid impermeable material joined together to provide curtains of intended length.

9. The barrier of claim 8 including a plurality of stiffening rods spaced along the length of each of the first and second curtains and extending from the top of the curtains toward the bottom of the curtains.

10. The barrier of claim 9 wherein each of the first and second curtains include pockets for retaining respective stiffening rods.

11. The barrier of claim 7 wherein the first and second curtains each include reinforcing webs provided along the top and bottom of the curtains and along the ends of the curtains.

12. The barrier of claim 7 wherein the plurality of floats include at each location along the length of the curtains a first float disposed between the curtains and second and third floats disposed on respective outer sides of the curtains; and an attachment mechanism for attaching the floats to the curtains.

13. The barrier of claim 7 wherein the bottom web is of the same flexible liquid impermeable material as the first and second curtains and wherein the bottom web and first and second curtains are joined together by stitching.

* * * * *